US006546887B2

(12) United States Patent
Kennedy

(10) Patent No.: US 6,546,887 B2
(45) Date of Patent: Apr. 15, 2003

(54) MOVABLE BULKHEAD

(75) Inventor: Stephen J. Kennedy, Ottawa (CA)

(73) Assignee: Intelligent Engineering (Bahamas) Limited, Nassau (BA)

( * ) Notice: Subject to any disclaimer, the term of this patent is extended or adjusted under 35 U.S.C. 154(b) by 0 days.

(21) Appl. No.: 09/921,644

(22) Filed: Aug. 3, 2001

(65) Prior Publication Data

US 2003/0024455 A1 Feb. 6, 2003

(51) Int. Cl.[7] ..... B63B 3/68
(52) U.S. Cl. ..... 114/78; 114/74 A
(58) Field of Search ..... 114/78, 71, 65 R, 114/74 A; 428/119, 314.4, 314.8, 317.1, 317.7, 319.1; 410/121, 130; 52/309.1, 309.9; 244/119, 117 R

(56) References Cited

U.S. PATENT DOCUMENTS

| | | | | | |
|---|---|---|---|---|---|
| 3,144,847 | A | * | 8/1964 | Valisalmi | 114/78 |
| 3,496,058 | A | * | 2/1970 | Schroter et al. | 428/319.1 |
| 3,573,144 | A | * | 3/1971 | Andersen | 428/119 |
| 3,623,290 | A | * | 11/1971 | Downing, Jr. | 52/241 |
| 3,812,808 | A | * | 5/1974 | Shirota et al. | 114/78 |
| 4,038,799 | A | * | 8/1977 | Shanks | 114/78 |
| 4,080,906 | A | * | 3/1978 | Brown | 410/130 |
| 4,161,561 | A | * | 7/1979 | Krug | 428/319.1 |
| 4,346,133 | A | * | 8/1982 | Hipchen et al. | 428/317.9 |
| 4,463,043 | A | * | 7/1984 | Reeves et al. | 428/119 |
| 4,698,278 | A | * | 10/1987 | Prang | 428/319.1 |
| 5,086,723 | A | * | 2/1992 | Goldbach et al. | 114/74 A |
| 5,448,865 | A | * | 9/1995 | Palmersten | 52/309.9 |
| 5,580,636 | A | * | 12/1996 | Kampmann et al. | 428/57 |
| 5,778,813 | A | | 7/1998 | Kennedy | 114/74 A |
| 5,984,601 | A | * | 11/1999 | Jevaney et al. | 410/121 |
| 6,050,208 | A | | 4/2000 | Kennedy | 114/74 A |
| 6,053,120 | A | * | 4/2000 | Shields | 114/78 |
| 6,096,416 | A | * | 8/2000 | Altenberg | 428/317.1 |
| 6,171,705 | B1 | * | 1/2001 | Clifford | 52/309.9 |
| 6,279,287 | B1 | * | 8/2001 | Meadows | 52/309.9 |
| 6,308,491 | B1 | * | 10/2001 | Porter | 52/309.9 |
| 6,314,701 | B1 | * | 11/2001 | Meyerson | 52/309.9 |

FOREIGN PATENT DOCUMENTS

| | | |
|---|---|---|
| GB | A-2337022 | 8/1998 |
| WO | WO 01/32414 | 11/2000 |

* cited by examiner

*Primary Examiner*—S. Joseph Morano
*Assistant Examiner*—Lahs A. Olson
(74) *Attorney, Agent, or Firm*—Darby & Darby

(57) ABSTRACT

A movable bulkhead with a first side and a second side, said first and second sides having upper and lower edges and first and second ends, wherein a first layer with inner and outer surfaces defines at least part of said first side with said outer surface, and a second layer with inner and outer surfaces defines at least part of said second side with said outer surface, an intermediate layer comprised of elastomer being bonded between said inner surface of said first layer and said inner surface of said second layer so as to transfer shear forces between said first and second layers.

31 Claims, 5 Drawing Sheets

MOVABLE BULKHEAD

FIELD OF THE INVENTION

The present invention relates to movable bulkheads which can be positioned at predetermined locations along the length of a ship to create separate cargo holds More particularly the invention relates to movable grain bulkheads.

DESCRIPTION OF THE INVENTION

Typically two grain bulkheads are vertically stacked to form a temporary transverse cargo bulkhead. For the specific application of movable bulkheads to the transport of grain in cargo ships, the stacked bulkheads interlock along the line of intersection and locking pins in the ends of the bulkheads are used to locate and lock the bulkhead structure to the inner hold of the ship. Bulkheads may be loaded with a lateral pressure from a grain cargo on one side only if the adjacent hold is empty and for this reason the required strength of grain bulkheads is correspondingly high. When not in use, the bulkheads are stored at the end of the cargo hold, in a group of four. Safety laws require that doors and a fixed ladder must be provided in each bulkhead. This is for escape of dockyard workers into the next hold in the case of being trapped in a hold when filling of the hold begins or escape out of the hold in case the adjoining hold has already been filled.

Previously bulkheads have been made of a complex all steel construction consisting of a corrugated structure with plates welded to it to provide a flush surface and channels framing horizontally and vertically around the periphery. This steel structure is heavy, comprises a great number of pieces and requires many welds to hold it together.

A so-called "sandwich plate system" (SPS) is described in U.S. Pat. No. 5,778,813, incorporated herein by reference and British Patent Application GB-A-2,337,022, incorporated herein by reference. The sandwich plate system provides a structural sandwich plate member comprising first and second metal layers and an intermediate layer which is formed of an elastomer which is bonded to the metal layers with sufficient strength to transfer shear forces therebetween. The intermediate layer may also be a composite core as described in International Application No. WO 01/32414, incorporated herein by reference.

OBJECTS OF THE INVENTION

The object of invention is to provide a grain bulkhead which is an improvement over the prior art. A further object is to provide a grain bulkhead of a more simple construction than those of the prior art, which weighs less, comprises fewer parts and requires fewer welds to hold it together.

Further objects and advantages of the invention will become apparent from the following description.

SUMMARY OF THE INVENTION

The present invention provides a movable bulkhead for use in dividing the hold of a cargo vessel, said bulkhead comprising a sandwich plate member comprising first and second outer metal layers and an intermediate layer comprised of a plastics or polymer material bonded to said first and second outer metal layers with sufficient strength to transfer shear forces therebetween.

The movable grain bulkhead of the present invention is simple to assemble and is light whilst having the required strength and stiffness.

The movable grain bulkhead according to the present invention may further comprise an upper box beam and a lower box beam, the upper box beam forming the upper edge of the first and second sides and the lower box beam forming the lower edges of the first and second sides.

This preferred embodiment has the advantage of further reducing weight.

The movable grain bulkhead of the present invention may further comprise a plurality of forms located between the first and second layers.

This preferred embodiment also has the advantage of further reducing the weight of the movable grain bulkhead and of further structural simplification.

BRIEF DESCRIPTION OF THE DRAWINGS

The invention will now be described by way of example only with reference presently preferred embodiments and to the accompanying drawings in which.

DETAILED DESCRIPTION OF THE PREFERRED EMBODIMENTS

Like numerals are used throughout the Figures to represent like parts.

Figure 1:
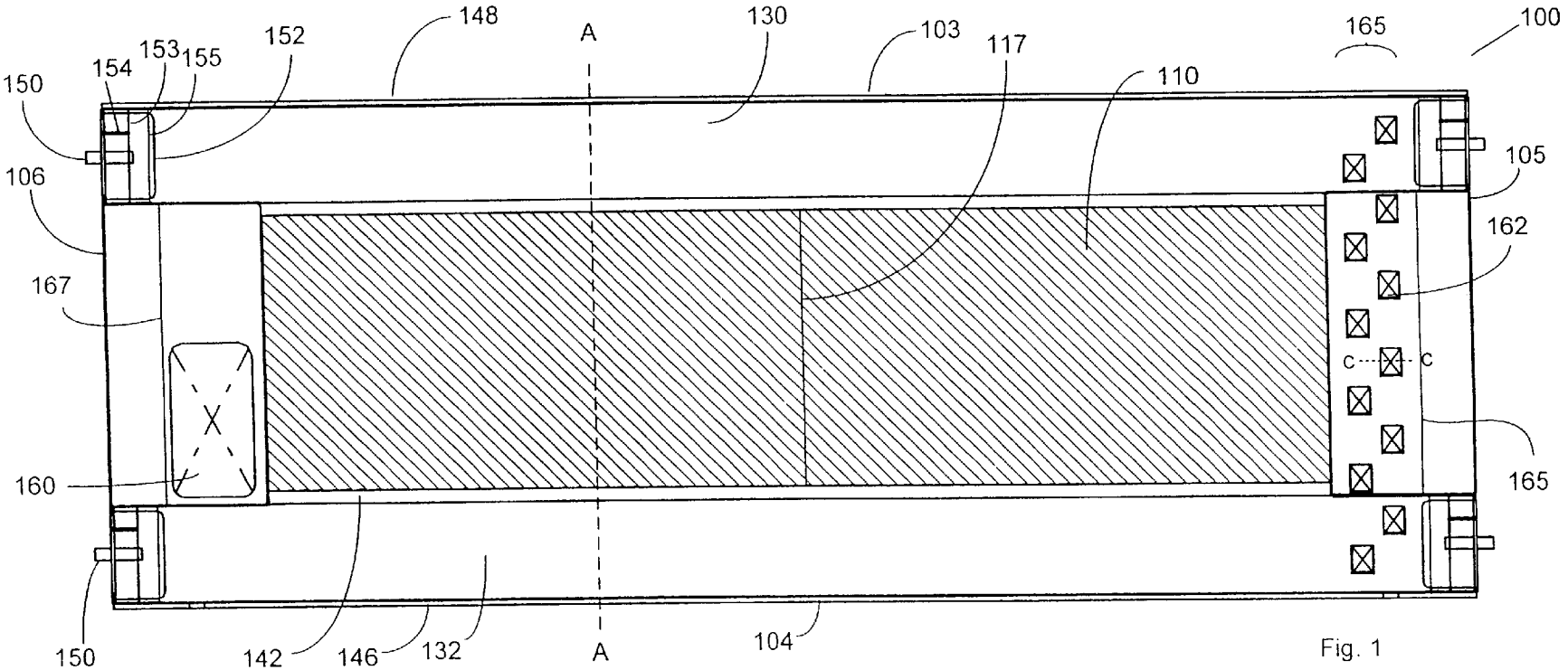
FIG. 1 is an elevation of a movable grain bulkhead according to a first embodiment of the present invention.

A first embodiment of movable bulkhead is illustrated in FIG. 1. The bulkhead 100 is of a generally rectangular shape defined by an upper edge 103, a lower edge 104, a first end 105 and a second end 106. As can be seen from FIG. 2, which is a cross-section taken through line A—A of FIG. 1, the grain bulkhead has a first side 101 and a second side 102.

A first layer 110 defines, with an outer surface, at least part of the first side 101. A second layer 120, defines with an outer surface, at least part of the second side 102. Between the first layer 110 and the second layer 120 on inner surfaces, opposite the outer surfaces, an intermediate layer 115 is bonded. The intermediate layer is comprised of an elastomer and is bonded between the inner surfaces of the first and second layers 110, 120 so as to transfer shear forces between the first and second layers 110, 120. The construction comprising the first layer 110, the second layer 120 and intermediate layer 115 is a so-called SPS structure, the construction of which is described in the documents mentioned above.

Figure 2:
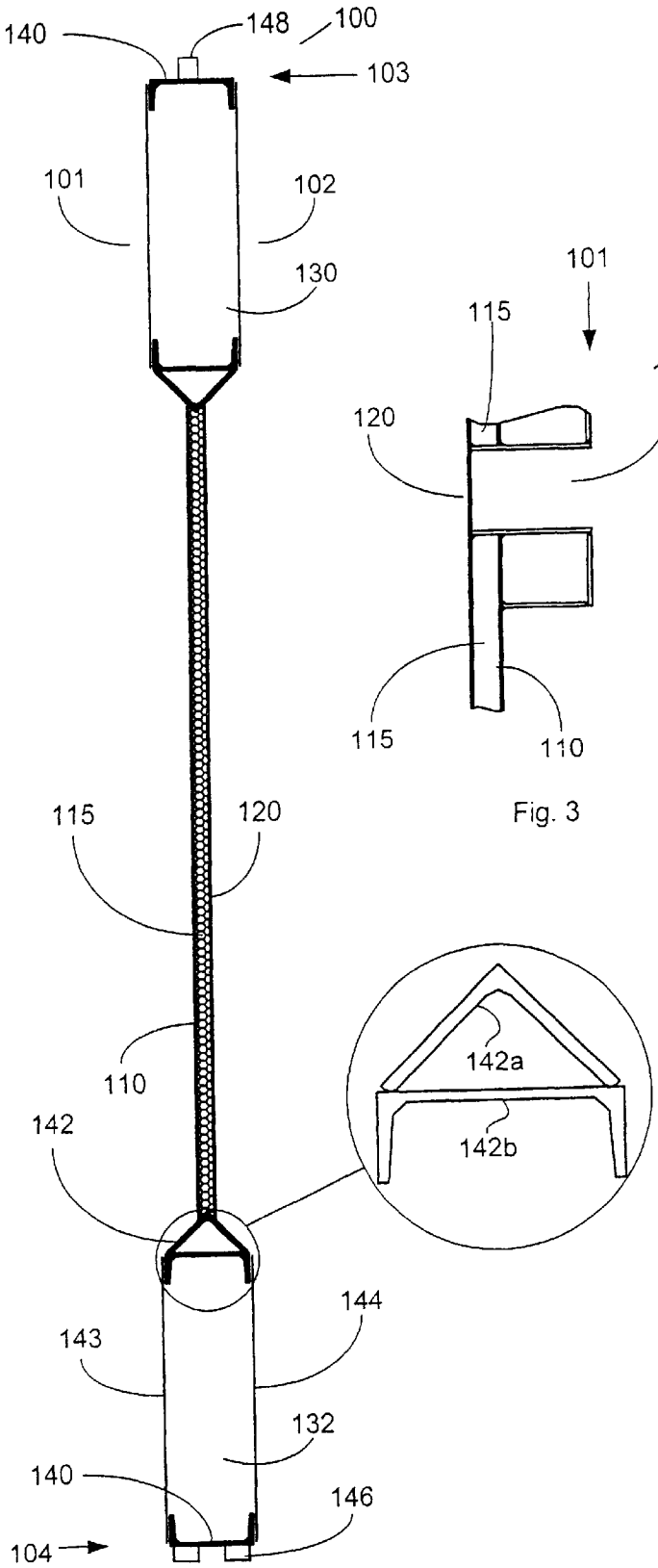
FIG. 2 is a cross-sectional view of a movable grain bulkhead according to the first embodiment taken through line A—A in FIG. 1.

As can be seen from FIG. 1, the first and second layers 110, 120 do not extend to the upper edge 103 or the lower edge 104. Between the first and second layers 110, 120, and the upper edge 103 is a top box beam 130. Between the first and second layers 110, 120 and the lower edge 104 is a bottom box beam 132. The top and bottom box beams 130, 132 are constructed in a similar way and this is best illustrated in FIG. 2. The top and bottom box beams 130, 132 comprise a U-shaped section, section 140 which forms the upper and lower edges 103, 104. Opposite to this section 140 is an A-shaped cross-section 142, which is comprised of an equal leg angle 142*a* and a channel section 142*b*. Attached between section 140 and section 142 are external face plates 143 and 144. The first and second layers 110, 120 are attached to the A-shaped sections 142 of the upper and lower box beams 130, 132.

Figure 6:
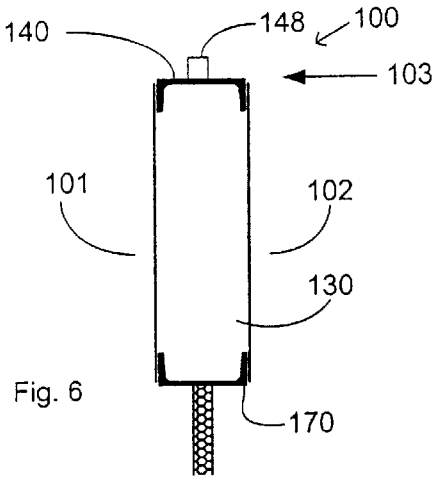
FIG. 6 is a cross-sectional view of the upper part of a variant of the first embodiment.
Figure 7:
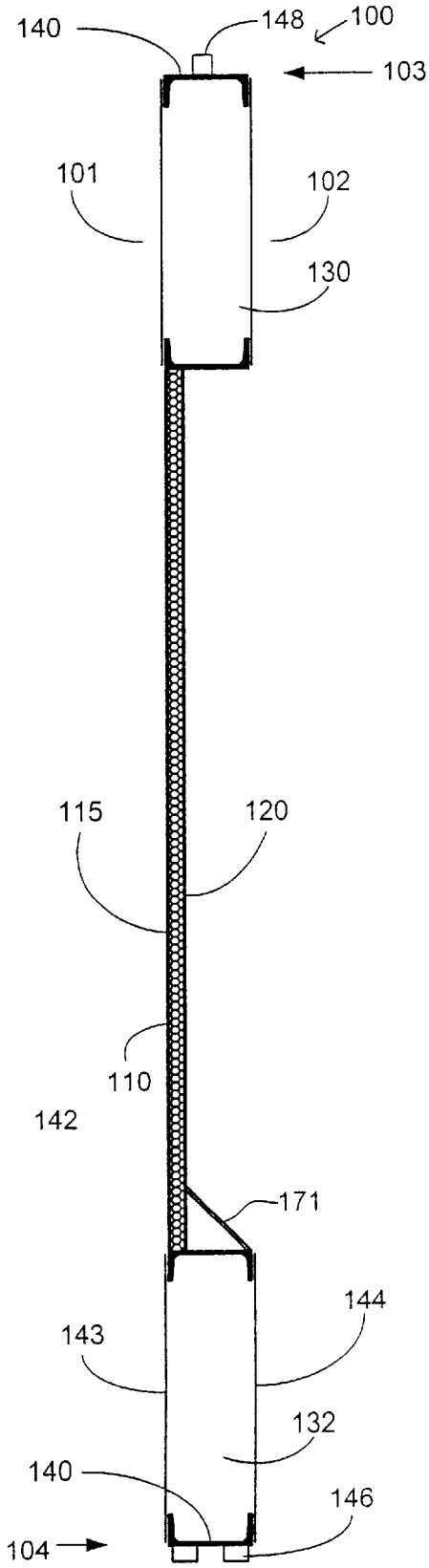
FIG. 7 is a cross-sectional view of another variant of the first embodiment.

Some variants on the first embodiment are shown in FIGS. 6 and 7. As shown in FIG. 6, the angle attaching the SPS panel to the upper box beam 130 is omitted as it is not necessary to deflect grain.

In FIG. 7, the SPS panel 110, 115, 120 is offset so as to be aligned with one face of the upper and lower box beams 130, 132. A deflector plate 171 is provided to prevent grain piling up on the ledge formed by lower box beam 132.

In the embodiment illustrated in FIG. 1, there is a series of recesses 162 in the first side 101 of the movable grain bulkhead 100. The plurality of recesses 162 form steps 165 from the lower edge 104 to the upper edge 103. Some of the plurality of recesses 162 are located between the first or second layers 110, 120 and the steel plate 112 forming the end box 105.

A through-hole in the movable bulkhead 100 from the first side 101 to the second side 102 is covered with a door 160 which can be opened and closed. The door 160 and the steps 165 allow dockyard workers to move from one hold to another or to escape from the hold if they are trapped in a hold when filling of the hold begins.

Figure 8:
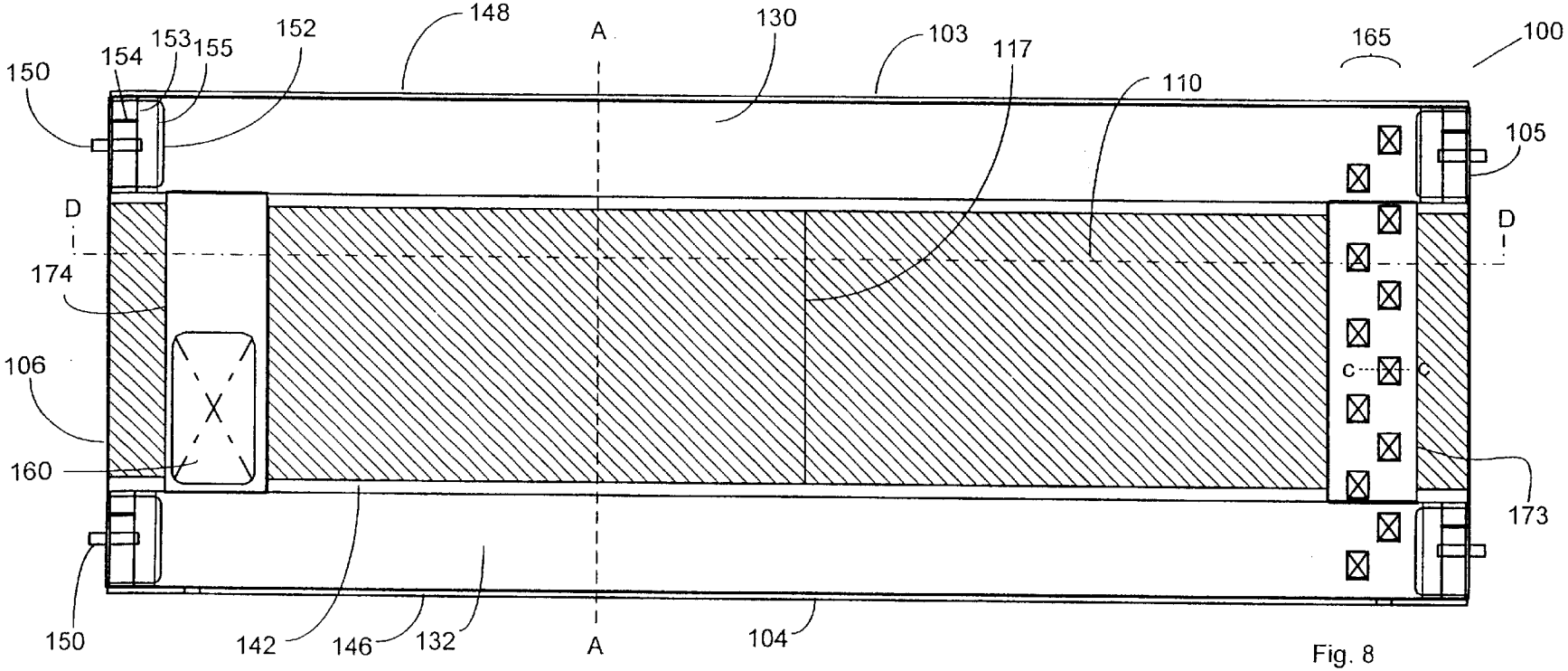
FIG. 8 is an elevation of a further variant of the first embodiment.
Figure 9:
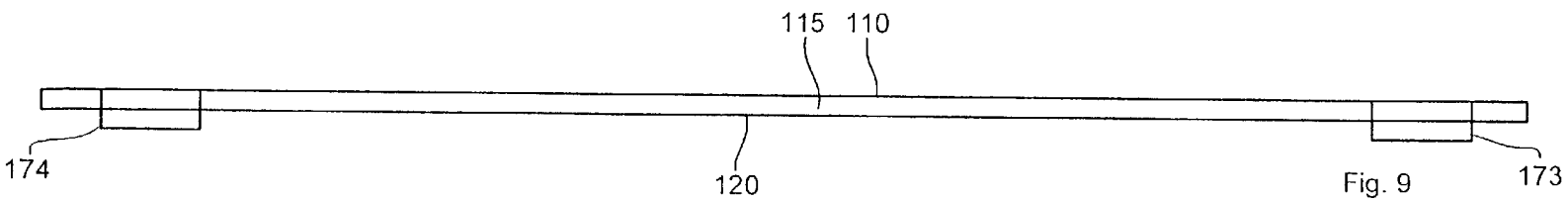
FIG. 9 is a cross-sectional view taken along the line D—D in FIG. 8.

In the arrangement shown in FIG. 1, the SPS plate extends over the central shaded area. The top and bottom box beams 130, 132 and the side sections are all steel constructions. In an alternative arrangement, shown in FIGS. 8 and 9, the SPS plate extends the full width of the bulkhead. Two vertical box beams 173, 174 are provided to accommodate the steps 165 and door 160.

One or more spacers 117, attached between the first layer 110 and the second layer 120, are optionally used to split the space between the first and second layers 110, 120 into a plurality of chambers or cavities. In the illustrated embodiment only a single vertical spacer 117 is illustrated. However, as will be apparent to those skilled in the art, several vertical and horizontal spacers may be used in any combination.

Figure 3:
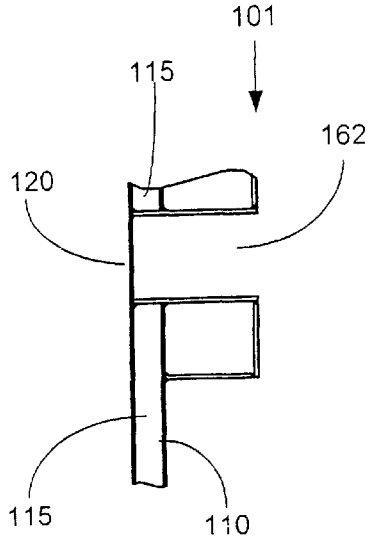
FIG. 3 is a cross-sectional view of a recessed step in a movable grain bulkhead according to a variation of the first embodiment of the present invention taken through the line C—C in FIG. 1.

FIGS. 1 and 2 illustrate an elevation and the cross-section for a movable grain bulkhead with an SPS panel that is centered with respect to its width. A inor variation eliminates the angle which attaches the SPS panel to the upper box beam 103 as it is not required to deflect grain and simplifies the construction. An alternate variation offsets the SPS panel so that it is aligned with one edge of both the upper and lower box beams. The SPS panel extends the full width of the hold between end members 105 and 106. Vertical steel box beams, equal in width and extending between the upper and lower box beams, are located locally to house the door and recessed steps. FIG. 3 illustrates a section through this box beam with a typical recessed step which extends to one of the layers of the SPS panel 110 or 120. This minor modification further simplifies the construction and reduces the bulkhead's weight.

The grain bulkhead 100 also comprises locking pins 150 which are used to align and fix the bulkhead with the inner hold of the ship. In the first embodiment the locking pins project from the first and second ends 105, 106 in positions close to the upper and lower edges 103, 104 when the pins are withdrawn (recessed) into pockets 152 of the horizontal box beams 130 and 140. In the first embodiment each box beam has associated with it a two locking pins 150, one at the first end 105 and one at the second end 106. The pocket 152 is located between the first and second sides 101, 102 and surrounds part of the associated locking pin 150 which is inserted between the first and second sides 101, 102. The pocket is further comprised of stiffening plates 153, 154 which act as guides for the locking pin.

In order that one movable grain bulkhead according to the present invention may be stacked on top of another movable grain bulkhead according to the present invention, guides (simple flat bars) are attached on the upper and lower edges 103, 104. Two locators 146 in spaced apart relationship are attached on the U-shaped beam 104 of the upper box beam 130 and one spacer 148 is attached on the U-shaped beam 104 of the lower box beam 132. The lower spacers 146 are spaced apart such that an upper spacer 148 can be positioned between them. The interlocking of these bars 146, 148 provides a shear connection between stacked bulkheads.

Figure 5:
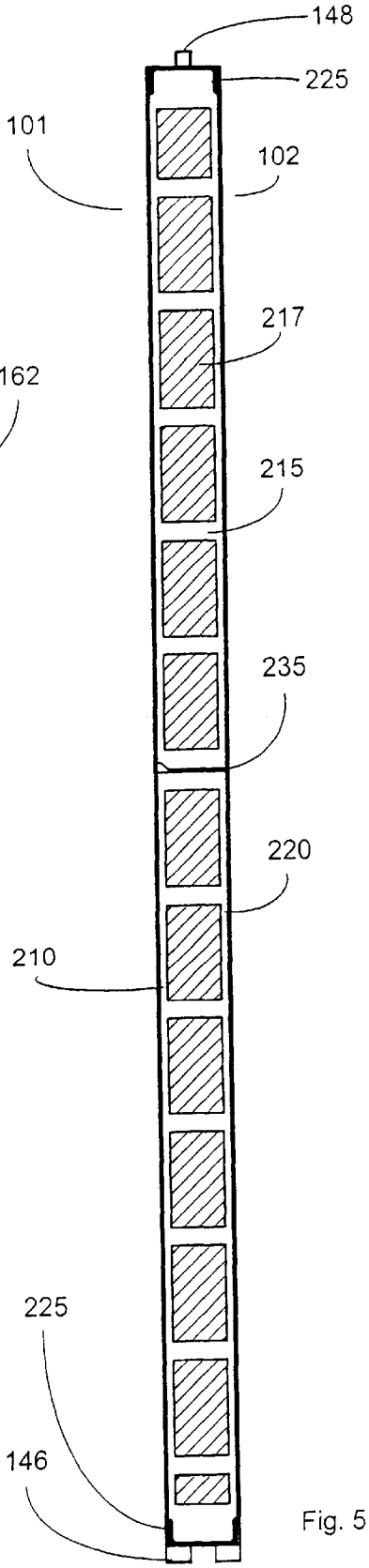
FIG. 5 is a cross-sectional view taken through line B—B in FIG. 4.
Figure 4:
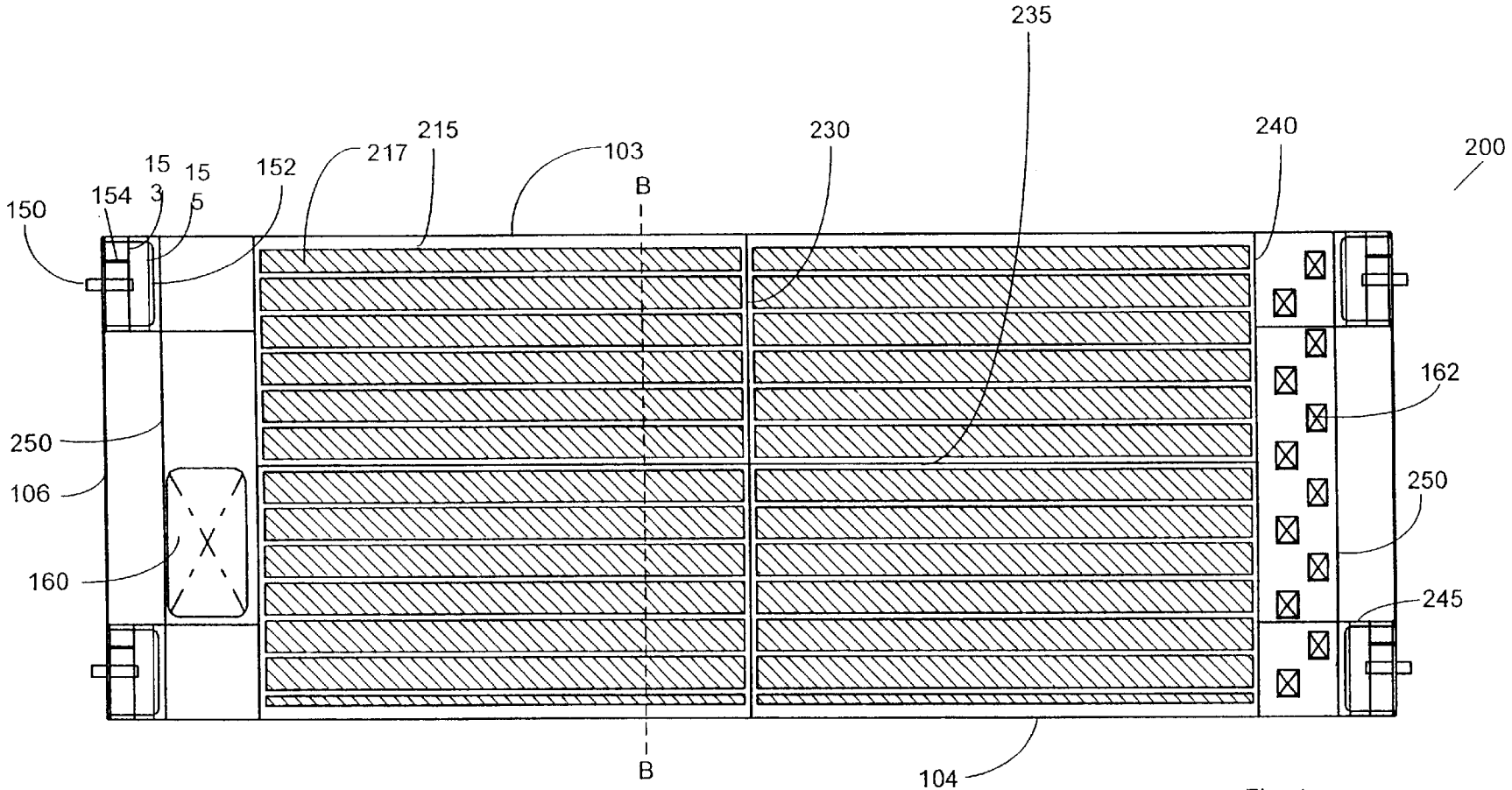
FIG. 4 is an elevation of a movable grain bulkhead according to a second embodiment of the present invention.

FIG. 4 illustrates, in plan view, a second embodiment according to the present invention. FIG. 5 is a cross-sectional view taken through line B—B in FIG. 4. In this embodiment a first layer 210 defines, on its outer surface, the first side 101 of the grain bulkhead 200. A second layer 220, defines on its outer side the second side 102 of the grain bulkhead 200. The first and second layers 210, 220 extend substantially up to the outer edge 103 and lower edge 104 of the bulkhead. The first and second layers 210, 220 are connected at the upper and lower edges 103, 104 with U-shaped beams 225. The cavity between the first and second layers 210, 220 is divided by a plurality of vertical spaces 230, 240, 250 connected between the first and second layers and by a horizontal spacer 235 also connected between the first and second layers 210 or 220. Any number of vertical and horizontal spaces may be used. In between the first and second layers are a plurality of forms 217. An intermediate layer 215 comprised of elastomer fills the space in the cavities not occupied by the forms 217 and is bonded between the inner surface (opposite the outer surface) of the first and second layers 210, 220 so as to transfer shear forces between the first and second layers.

The forms 217 may be made of any type of lightweight foam material, e.g. polyurethane (PU) foam, which does not react with (metal) layers 210, 220 or with the elastomer. Preferably the form is sufficiently rigid so as not to be easily compressed by the first and second layers 210, 220 or the intermediate layer 215. The form 217 may be moulded to a specific shape or constructed in a generic manner of specific thicknesses. In the limit, these forms may be air inflated plastic or rubberized tubes. In the embodiment illustrated in FIGS. 4 and 5 the forms 217 have a rectangular cross-section and only contact the first and second layers 210, 220 in limited areas. This is not necessary in all cases and the forms may make contact with the first and second layers 210, 220 along their entire length and may have any cross-section including irregular cross-sections.

In the areas between the forms 217 and the ends 105, 106 of the bulkhead 200, recesses 162, a door 160 and pockets for locking pins 150 are assembled as in the first embodiment. Because the second embodiment does not have top and bottom box beams, a horizontal stiffening plate 245 is positioned between the ends 105, 106 along with a vertical stiffener 250 to form the borders for the pocket which houses the locking pins.

In the above two described embodiments all of the components except for the intermediate layers 115, 215 and forms 217 are made of metallic materials, preferably steel. The bulkheads are manufactured by welding together the steel components and, in the first example, injecting the intermediate layer 115 as a final step using a method as described in British Patent Application GB-A-2,337,022.

In the case of the second embodiment, before the step of placing the second layer 220 onto the spacers 235, 230, 240 which have already been welded to the first layer 210, the forms 217 are inserted into their relevant positions. After the forms 217 have been positioned, the second layer 220 is attached to the spaces 230, 235, 240 and finally the intermediate layer 215 is injected into the spaces in the cavities between the forms 217 as is described in United Kingdom Patent Application No. 9926333.7.

Whilst an embodiment of the invention has been described above, it should be appreciated that this is illustrative and not intended to be limitative of the scope of the invention, which is defined in the appended claims.

I claim:

1. A movable bulkhead for use in dividing the hold of a cargo vessel into a first cargo hold section and a second cargo hold section, the first and second cargo hold sections being adjacent cargo hold sections, said bulkhead comprising a sandwich plate member comprising:

a first metal layer, the first metal layer including an outer surface and an inner surface, the outer surface of the first metal layer defining a first outer surface of the bulkhead, the first outer surface of the bulkhead defining a wall of the first cargo hold section;

a second metal layer, the second metal layer including an outer surface and an inner surface, the outer surface of the second metal layer defining a second outer surface of the bulkhead, the second outer surface of the bulkhead defining a wall of the second cargo hold section; and an intermediate layer comprising a material bonded to the inner surfaces of the first and second metal layers with sufficient strength to transfer shear forces therebetween, wherein the material occupies substantially the entire extent between the inner surfaces of the first and second metal layers and the material comprises at least one of a plastic and a polymer.

2. A movable bulkhead according to claim 1 further comprising first and second box beams extending across the top and bottom respectively of said sandwich plate member.

3. A movable bulkhead according to claim 2 wherein said first and second box beams have a thickness greater than the thickness of said sandwich plate member.

4. A movable bulkhead according to claim 3 further comprising an angle section joining said sandwich plate member to said second box beam.

5. A movable bulkhead according to claim 3 wherein said sandwich plate member is connected to said second box beam such that a first face of said sandwich plate member is substantially flush with a first face of said second box beam and further comprising an inclined plate connected between a second face of said sandwich plate member opposite said first face thereof and a corner of said second box beam.

6. A movable bulkhead according to claim 2 further comprising first and second steel side sections extending between the top and bottom of said sandwich plate member.

7. A movable bulkhead according to claim 6 wherein said first and second steel side sections provide a doorway through said bulkhead and a set of steps.

8. A movable bulkhead according to claim 2 wherein said sandwich plate member extends substantially the full width of said bulkhead.

9. A movable bulkhead according to claim 8 further comprising at least one vertical box beam extending between said first and second box beams spaced from the edge of said sandwich plate member.

10. A movable bulkhead according to claim 9 wherein said at least one vertical box beam accommodates a door through said bulkhead and a set of steps.

11. A movable bulkhead according to claim 1 wherein said sandwich plate member extends substantially the entire width and height of said movable bulkhead.

12. A movable bulkhead according to claim 11 wherein said intermediate layer comprises at least one low-density form and said plastics or polymer material occupies all of the space between said metal layers not occupied by said form.

13. A movable bulkhead according to claim 12 wherein the or each said low-density form is elongate and arranged along the width direction of said bulkhead.

14. A movable bulkhead according to claim 12 wherein said low-density form comprises a foam material or an inflated tube.

15. A movable bulkhead according to claim 1, wherein at least one metal spacer is positioned between said first and second metal layers thereby to divide said intermediate layer into a plurality of separate sections.

16. A cargo vessel incorporating a movable bulkhead according to claim 1.

17. A movable bulkhead for use in dividing the hold of a cargo vessel into first and second cargo hold sections, the first and second cargo hold sections being adjacent cargo hold sections, said bulkhead comprising a sandwich plate member comprising first and second outer metal layers and an intermediate layer comprising at least one of a plastic and a polymer material bonded to said first and second outer metal layers with sufficient strength to transfer shear forces therebetween, the movable bulkhead further comprising first and second steel side sections extending between the top and bottom of said sandwich plate member, wherein the first and second outer metal layers define walls of the first and second cargo hold sections, respectively.

18. A movable bulkhead according to claim 17 comprising first and second box beams extending across the top and bottom respectively of said sandwich plate member.

19. A movable bulkhead according to claim 18, wherein said first and second box beams have a thickness greater than the thickness of said sandwich plate member.

20. A movable bulkhead according to claim 19 comprising an angle section joining said sandwich plate member to said second box beam.

21. A movable bulkhead according to claim 19, wherein said sandwich plate member is connected to said second box beam such that a first face of said sandwich plate member is substantially flush with a first face of said second box beam and comprising an inclined plate connected between a second face of said sandwich plate member opposite said first face thereof and a corner of said second box beam.

22. A movable bulkhead according to claim 17, wherein said first and second steel side sections provide a doorway through said bulkhead and a set of steps.

23. A movable bulkhead according to claim 17, wherein said sandwich plate member extends substantially the full width of said bulkhead.

24. A movable bulkhead according to claim 18 comprising at least one vertical box beam extending between said first and second box beams spaced from the edge of said sandwich plate member.

25. A movable bulkhead according to claim 24, wherein said at least one vertical box beam accommodates a door through said bulkhead and a set of steps.

26. A movable bulkhead according to claim 17, wherein said sandwich plate member extends substantially the entire width and height of said movable bulkhead.

27. A movable bulkhead according to claim 17, wherein said intermediate layer comprises at least one low-density form and said plastics or polymer material occupies all of the space between said metal layers not occupied by said form.

28. A movable bulkhead according to claim 27, wherein the or each said low-density form is elongate and arranged along the width direction of said bulkhead.

29. A movable bulkhead according to claim 27, wherein said low-density form comprises a foam material or an inflated tube.

30. A movable bulkhead according to claim 17, wherein at least one metal spacer is positioned between said first and second outer metal layers thereby to divide said intermediate layer into a plurality of separate sections.

31. A cargo vessel incorporating a movable bulkhead according to claim 17.

* * * * *